US007927177B1

(12) United States Patent
Walterscheid

(10) Patent No.: US 7,927,177 B1
(45) Date of Patent: Apr. 19, 2011

(54) POP ACTION TOY BALL

(76) Inventor: Steve Walterscheid, Bend, OR (US)

( * ) Notice: Subject to any disclaimer, the term of this patent is extended or adjusted under 35 U.S.C. 154(b) by 314 days.

(21) Appl. No.: 12/120,651

(22) Filed: May 15, 2008

(51) Int. Cl.
*A63H 33/00* (2006.01)

(52) U.S. Cl. ..... 446/486; 446/4; 446/308; D21/436

(58) Field of Classification Search ..... 446/486, 446/308, 311, 312, 14, 490, 459, 4–6; D21/405–406, D21/412, 310, 436; 472/134, 135
See application file for complete search history.

(56) References Cited

U.S. PATENT DOCUMENTS

| | | | | | |
|---|---|---|---|---|---|
| 564,686 | A | * | 7/1896 | Gottschalk et al. | 446/192 |
| 1,639,602 | A | * | 8/1927 | Gay | 446/54 |
| 1,676,296 | A | * | 7/1928 | Spencer | 446/14 |
| 2,153,957 | A | | 4/1939 | Davis | 46/1 |
| 2,627,700 | A | * | 2/1953 | Weiss | 446/312 |
| 2,952,460 | A | * | 9/1960 | Ellis | 473/609 |
| 3,218,071 | A | * | 11/1965 | Richard | 473/594 |
| 5,213,538 | A | | 5/1993 | Willett | 446/4 |
| 5,984,753 | A | * | 11/1999 | Perez | 446/46 |
| D527,427 | S | * | 8/2006 | Andersen | D21/398 |
| 7,803,033 | B1 | * | 9/2010 | Walterscheid | 446/486 |

* cited by examiner

*Primary Examiner* — Gene Kim
*Assistant Examiner* — Matthew B Stanczak
(74) *Attorney, Agent, or Firm* — LaMorte & Associates

(57) ABSTRACT

A pop action toy ball assembly. The pop action toy ball assembly has a lower hemispherical section and a separate upper hemispherical section. The two hemispherical sections are joined together by a connection element. The connection element has one end that is anchored to the apex of the lower hemispherical section. The connection element extends upwardly through the apex of the upper hemispherical section without being affixed to the upper hemispherical section. The lower hemispherical section is selectively positionable between a normal orientation, where a first surface faces outwardly, and an inverted orientation, where a second surface faces outwardly. If the toy ball assembly is impacted while the lower hemispherical section is inverted, the toy assembly pops from its inverted orientation back into its normal orientation.

12 Claims, 5 Drawing Sheets

POP ACTION TOY BALL

BACKGROUND OF THE INVENTION

1. Field of the Invention

In general, the present invention relates to toys that are spring loaded and pop up into the air when activated. More particularly, the present invention relates to toys that contain a hemispherical structure that is inverted to store the spring energy needed to pop the toy into the air.

2. Prior Art Description

Rubber balls have been commercially manufactured for well over a century. Early toy rubber balls were made from two hemispherical pieces of rubber that were glued together to form the shape of the ball. As the balls were played with, it was not uncommon for the two halves of the ball to separate. A child playing with the ball would then have two half balls. Half balls were so common that many childhood games required the use of a "half ball".

One game played with a half ball was to invert the half ball so that it would pop. When a half ball is inverted it stores energy like a spring. If the inverted ball were dropped or touched, the half ball would pop back into its hemispherical shape, thereby releasing the stored energy. The popping action of the half ball would cause the half ball to fly up into the air.

Recognizing the play value of half balls, toy manufacturers began to manufacture half balls and configure the half balls to optimize the popping action. Such half balls are exemplified by U.S. Pat. No. 2,153,957 to Davis, entitled Jumping ball, which was patented in 1938. A more modern variation of a half ball is disclosed in co-pending U.S. patent application Ser. No. 11/879,713, entitle Pop Action Toy.

In other variations of half ball designs, secondary objects, such as dolls and superheroes have been attached to half balls. In this manner, when the half ball pops and flies into the air, so does the toy character. Half balls that carry secondary characters are exemplified by U.S. Pat. No. 5,213,538 to Willett, entitled Pop-Action Bouncing Doll.

Although half balls have many features that make them better than full balls, half balls also have many features that make them less desirable than a full ball. For instance, a half ball is not very aerodynamic. Accordingly, a half ball cannot be thrown as far as a full ball. Likewise, the odd shape of a half ball makes the half ball hard to catch and prevents the half ball from rolling.

A need therefore exists for a toy ball configuration that combines the novel features of a half ball with the advantages of a full ball. In this way, the toy ball can pop like a half ball, but can roll, fly and be caught like a spherical full ball. This need is met by the present invention as described and claimed below.

SUMMARY OF THE INVENTION

The present invention is a pop action toy ball assembly. The pop action toy ball assembly includes a lower hemispherical section and a separate upper hemispherical section. The two hemispherical sections are joined together by a connection element. The connection element has one end that is anchored to the apex of the lower hemispherical section. The connection element extends upwardly through the apex of the upper hemispherical section without being affixed to the upper hemispherical section.

The lower hemispherical section has an elastomeric body that is defined primarily by a first surface and a second surface. Both the first surface and the second surface extend from a wide base rim to a central apex. The elastomeric body is selectively positionable between a normal orientation, where the first surface faces outwardly, and an inverted orientation, where the second surface faces outwardly.

The lower hemispherical section is stable when manipulated into its inverted orientation. If the toy ball assembly is impacted while the lower hemispherical section is inverted, the toy assembly pops from its inverted orientation back into its normal orientation. The popping action releases energy stored in the lower hemispherical section. The release of energy can be used to cause the toy ball assembly to rebound away from an impacted object.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
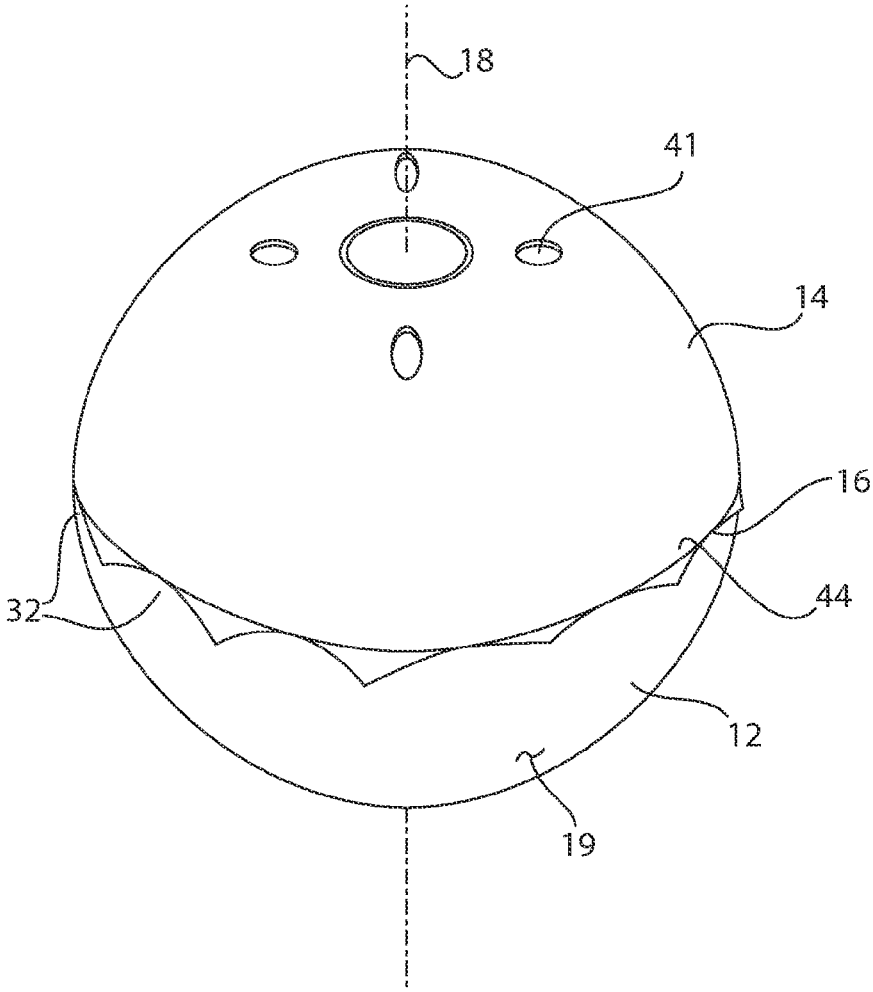
FIG. 1 is a perspective view of an exemplary embodiment of a pop action toy ball in its normal configuration.
Figure 2:
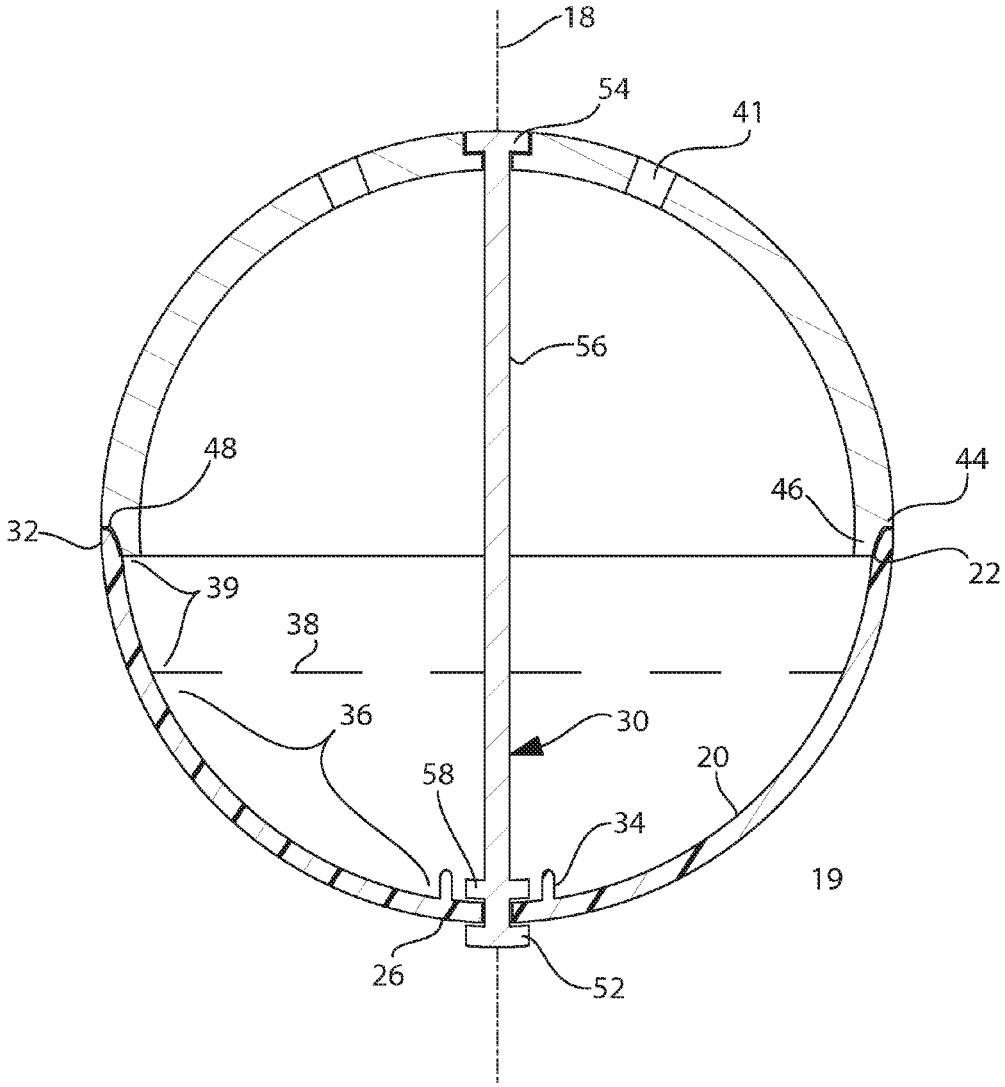
FIG. 2 is an exploded view of the exemplary embodiment of FIG. 1.
Figure 3:
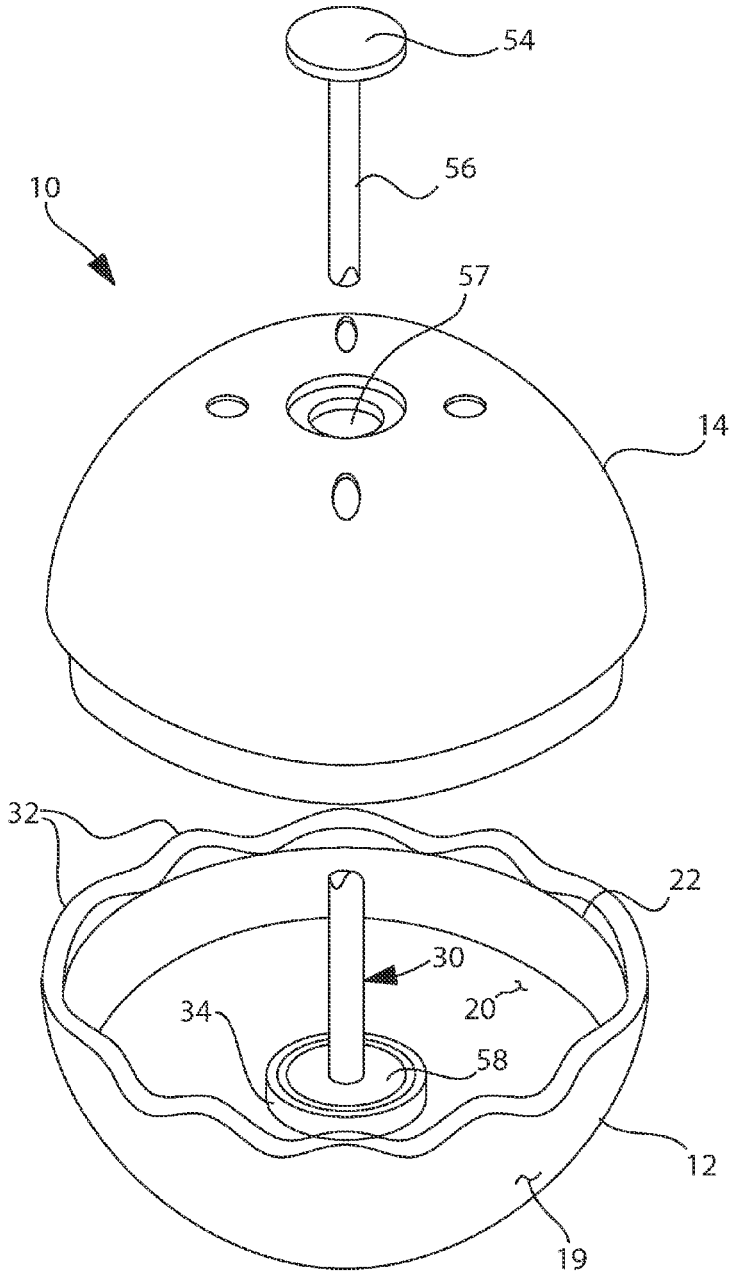
FIG. 3 is a cross-sectional view of the embodiment of FIG. 1.

Referring to FIG. 1 in conjunction with both FIG. 2 and FIG. 3, a pop action toy ball 10 is shown in its normal configuration. The pop action toy 10 is made from two hemispherical sections 12, 14 that abut along a common abutment joint 16 that encircles the pop action toy ball 10. Both hemispherical sections 12, 14 of the pop action toy ball 10 are symmetrically disposed around an imaginary mid-axis 18 that passes through the geometric center of the pop action toy ball 10. Accordingly, it will be understood that the abutment joint 16 exists in a plane that is perpendicular to the imaginary mid-axis 18.

The two hemispherical sections 12, 14 of the pop action toy ball 10 are made of different materials. The lower hemispherical section 12 is made of an elastomeric material with a relatively high durometer, such as rubber or a synthetic rubber. The upper hemispherical section 14 is made from an elastomeric material with a relatively low durometer, such as foam rubber. Due to the difference in materials, the lower hemispherical section 12 is denser and heavier than is the upper hemispherical section 14.

The lower hemispherical section 12 is defined primarily by a first surface 19 and a second surface 20. The first surface 19 and the second surface 20 both extend from a wide base rim 22 toward a central apex region. When the lower hemispherical section 12 is in its normal configuration, as is shown in FIG. 1, the first surface 19 presents the exterior of the lower hemispherical section 12.

An aperture 26 is formed in the apex region of the lower hemispherical section 12 along the mid-axis 18. The aperture 26 holds a connection element 30, the structure and function of which will be later explained.

The base rim 22 of the lower hemispherical section 12 exists in a plane that is perpendicular to the mid-axis 18. The first surface 19 of the lower hemispherical section 12 follows a consistent radius of curvature from its apex region down to the plane of the rim 22. Accordingly, the first surface 19 of the lower hemispherical section 12 is smooth and rounded. A plurality of protruding tabs 32 extend from the lower hemispherical section 12 above the base rim 22. The protruding tabs 32 are symmetrically disposed around the base rim 22 and lay in the vertical plane, parallel to the mid-axis 18. As will later be described, the protruding tabs 32 are used to help the pop action toy ball 10 pop from an inverted configuration into the shown normal configuration.

The second surface 20 of the lower hemispherical section 12 is complex in shape. When the lower hemispherical section 12 is in its normal configuration, as is shown, the second surface 20 is the interior surface of the lower hemispherical section 12. A cylindrical wall 34 extends downwardly from the second surface 20 in the central apex region. The cylindrical wall 34 encircles a portion of the connection element 30. A uniform section 36 of the second surface 20 extends from the cylindrical wall 34 to a transition line 38. The transition line 38 lay approximately between two-thirds and three-quarters of the way up the lower hemispherical section 12. In the uniform section 36, the lower hemispherical section 12 has a uniform thickness. Above the transition line 38, the lower hemispherical section 12 enters a tapered section 39 and begins to thin. The thickness of the lower hemispherical section 12 thins between 30% and 60%, from a first thickness at the transition plane 38 to a thinner second thickness at the base rim 22. The protruding tabs 32 maintain the second thickness along their lengths.

The upper hemispherical section 14 of the pop action toy ball 10 is made from soft rubber material or a synthetic rubber foam material. Accordingly, the upper hemispherical section 14 is easily deformed when contacted by a user's fingers. The thickness of the material is such that the upper hemispherical section 14 maintains its half ball shape when not stressed and does not collapse under the force of its own weight. However, the material is thin enough to enable a person to squash the upper hemispherical section 14 flat with a minimum of applied force.

Vent holes 41 are preferably formed through the material of the upper hemispherical section 14. The vent holes 41 prevent air from becoming trapped under the upper hemispherical section 14. This ensures that the upper hemispherical section 14 can be manually collapsed without much compression force.

The upper hemispherical section 14 is semispherical in shape, having a constant radius of curvature from an apex to its base rim 44. A tapered lip 46 extends downwardly from the base rim 22 of the upper hemispherical section 14. The tapered lip 46 has a diameter that is smaller than the base rim 44. Consequently, the tapered lip 46 is inset from the periphery of the base rim 22. This creates a ledge 48 along the base rim 44 that extends from the periphery of the base rim 44 to the onset of the tapered lip 46.

When the upper hemispherical section 14 and the lower hemispherical section 12 are in abutment in their normal positions, as is illustrated in FIGS. 1-3, it can be seen that the protruding tabs 32 from the lower hemispherical section 12 sit in the ledge 48 on the upper hemispherical section 14. The effect is that the upper hemispherical section 14 and the lower hemispherical section 12 create a complete round ball.

It will therefore be understood that when the upper hemispherical section 14 and the lower hemispherical section 12 are positioned as shown in FIG. 1, the pop action toy ball 10 can roll, can be thrown and can be caught in the same manner as a traditional round ball.

Referring to FIG. 3 in conjunction with FIG. 2, it can be seen that the upper hemispherical section 14 and the lower hemispherical section 12 are held together by a connection element 50. The connection element 50 includes an impact disc 52, a knurled knob 54, and an elongated shaft 56 that joins the impact disc 52 and the knurled knob 54 together. The shaft 56 extends along the mid-axis 18 and passes through both the aperture 26 in the apex of the lower hemispherical section 12 and an aperture 57 at the apex of the upper hemispherical section 14. Consequently, when the pop action toy ball 10 is in its normal configuration, the impact disc 52 extends beyond the first surface 19 of the lower hemispherical section 12 and the knurled knob 54 extends to the exterior of the upper hemispherical section 14.

A stop disc 58 is disposed on the elongated shaft 56. The stop disc 58 has a diameter that enables the stop disc 58 to pass into the area of the lower hemispherical section 12 that is defined by the cylindrical wall 34. It will therefore be understood that a segment of the lower hemispherical section 12 is interposed between the impact disc 52 and the stop disc 58. This holds the lower hemispherical section 12 in a fixed position relative to the elongated shaft 56.

Figure 4:
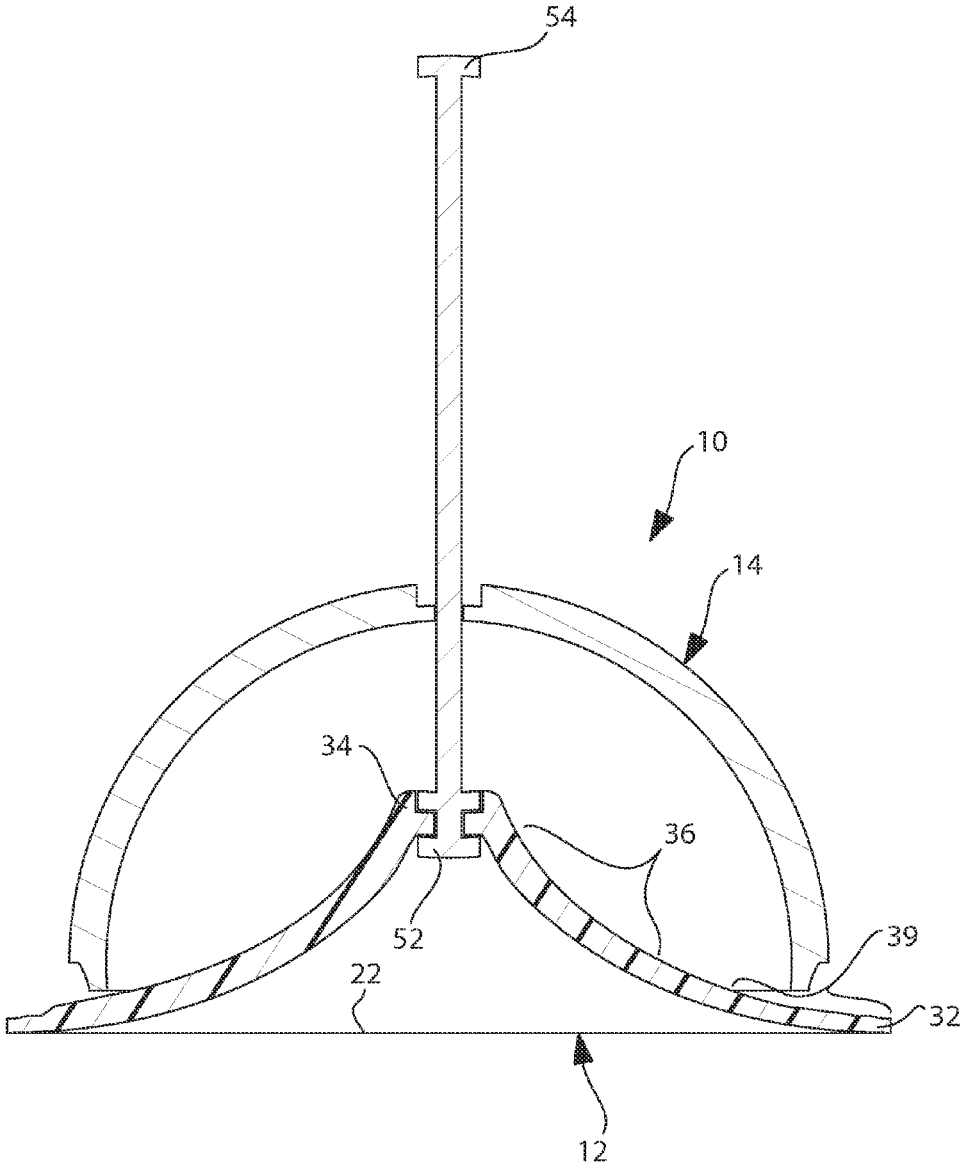
FIG. 4 is a cross-sectional view of an exemplary embodiment of a pop action toy ball in its inverted configuration.

Referring to FIG. 4, it can be seen that the lower hemispherical section 12 of the pop action toy ball 10 can be inverted. When the lower hemispherical section 12 is inverted, the lower hemispherical section 12 bends around the impact disc 52 of the connection element 30. Since the impact disc 52 has a diameter that is larger than the cylindrical wall 34, the cylindrical wall 34 must stretch to invert. The cylindrical wall 34, therefore, loses its cylindrical shape and becomes frustum shaped. As the cylindrical wall 34 stretches, it adds significantly to the spring energy that is stored within the inverted lower hemispherical section 12.

When the lower hemispherical section 12 is inverted, the uniform section 36 of the second surface 20 follows a first toric curvature. However, the tapered section 39, being less thick, deforms more readily and curves into the horizontal plane. Accordingly, the protruding tabs 32 that extend from the lower hemispherical section 12 extend primarily in a horizontal direction. It will therefore be understood that if the pop action toy ball 10 is placed upon a flat surface while inverted, the second surface 20 immediately proximate the base rim 22 would be in contact with that flat surface. The area in contact or near contact with the flat surface increases dramatically by the presence of the protruding tabs 32.

When the lower hemispherical section 12 is inverted, the elongated shaft 56 and the knurled knob 54 extends upwardly at the top of the pop action toy ball 10. The knurled knob 54 protrudes from the top of the upper hemispherical section 14 where it can be readily grasped by the hand of a person. Utilizing the knurled knob 54, a person can rotate the entire pop action toy ball 10 like a top. If the inverted pop action toy ball 10 is thrown as it is spun, the spinning action stabilizes the pop action toy ball 10 in flight. The pop action toy ball 10 sails through the air like a dart with a large suction cup head. When the pop action toy ball 10 lands, its stable flight orientation typically causes the wide base rim 22 to contact the ground first.

Any upward contact to the wide base rim 22 of the inverted lower hemispherical section 12 acts to cause the lower hemispherical section 12 to pop back into its original shape. Accordingly, if the pop action toy ball 10 is inverted and is dropped to the ground at any height greater than a few inches, the force of the impact with the ground will cause the inverted lower hemispherical section 12 to instantly pop back into its original hemispherical shape. The pop action is particularly sensitive to contact due to the protruding tabs 32. Since the protruding tabs 32 are periodically spaced around the periphery of the lower hemispherical section 12, it will be understood that one of the protruding tabs 32 is likely to strike the ground first if the pop action toy ball 10 strikes the ground slightly off kilter. An impact on one of the protruding tabs 32 concentrates the force of the impact into the small shape of the protruding tab 32. Consequently, only a small impact force will cause the inverted lower hemispherical section 12 to pop back into its original hemispherical shape.

Figure 5:
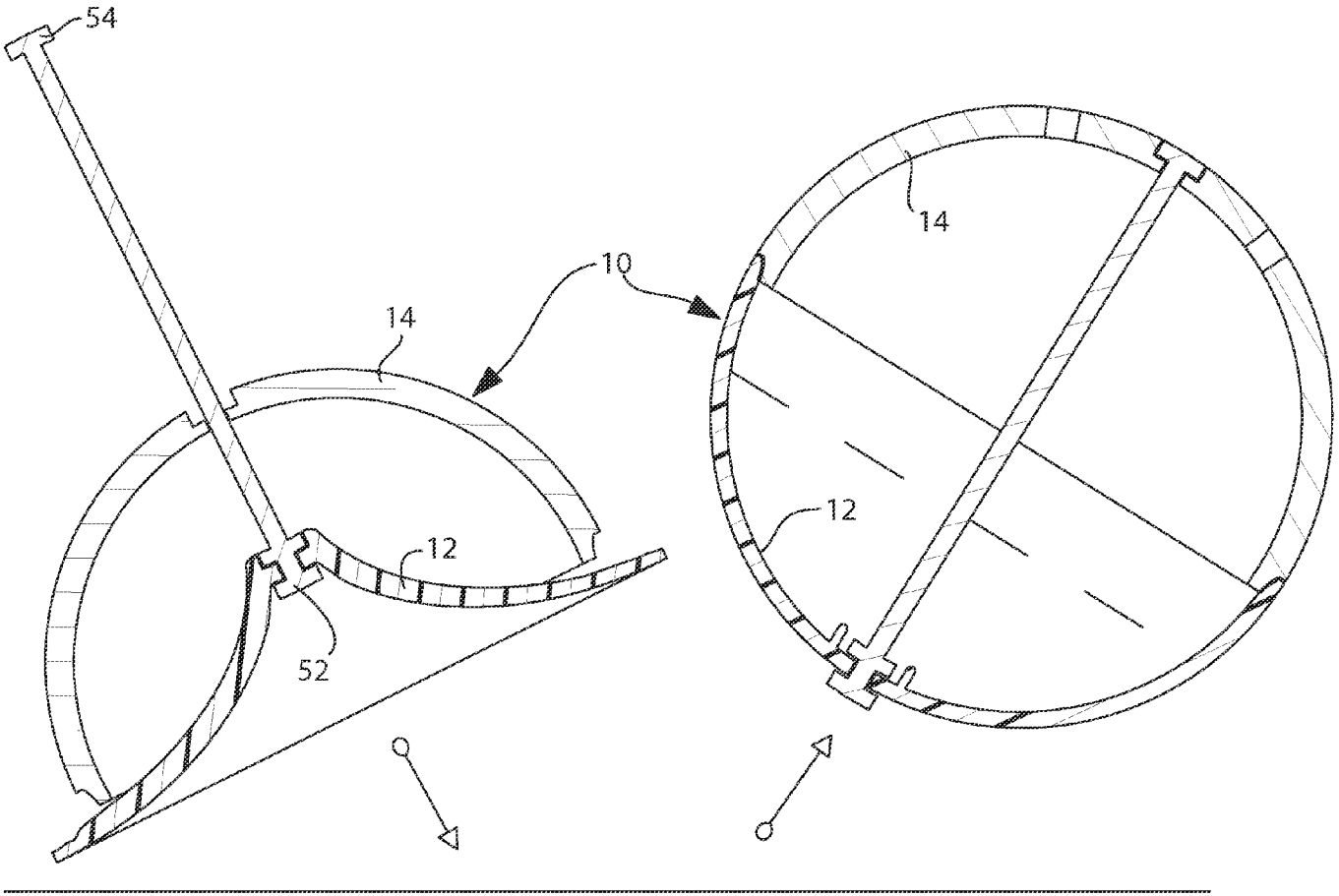
FIG. 5 illustrates the rebounding action of the pop action toy ball as it pops from an inverted configuration back into a normal configuration.

Referring to FIG. 5, in conjunction with both FIG. 3 and FIG. 4, it will be understood that to utilize the pop action toy ball 10, the lower hemispherical section 12 is manually manipulated into its inverted configuration. The upper hemispherical section 14 is soft and is easily deformed out of the way so that the lower hemispherical section 12 can be grasped. Once the lower hemispherical section 12 is inverted, a user then can grasp the knurled knob 54. Using the knurled knob 54, a person spins and throws the inverted pop action toy ball 10. The inverted pop action toy ball 10 flies through the air and eventually strikes the ground. At the moment of impact, a protruding tab 32 or another part of the wide base rim 22 strikes the ground. The force of the impact causes the inverted lower hemispherical section 12 to immediately convert back to its original hemispherical shape. At the moment of conversion, the energy stored in the inverted lower hemispherical section 12 is released. The stored energy causes the impact disc 52 of the connection element 30 to be driven downwardly and strike the ground. The reaction force supplies an upward force to the pop action toy ball 10. The pop action toy ball 10 will therefore rebound off the ground with great energy. Preferably, the energy utilized for the rebound causes the pop action toy ball 10 to fly up into the air to a height of between three and ten feet. The pop action toy ball 10 will therefore "bounce" up off the ground when dropped, often to a height greater than from where it was dropped.

As soon as the lower hemispherical section 12 pops out of its inverted configuration, the lower hemispherical section 12 abuts with the upper hemispherical section 14 and the pop action toy ball 10 returns to its original ball shape.

It will be understood that the embodiment of the present invention that is illustrated and described is merely exemplary and that a person skilled in the art can make many variations to that exemplary embodiment. For instance, the number, shape and size of the protruding tabs can be varied. The shape and size of the impact disc and knurled knob can also be varied. All such variations, modifications and alternate embodiments are intended to be included within the scope of the present invention as defined by the claims.

What is claimed is:

1. A pop action toy ball assembly, comprising:

a lower hemispherical section having a first surface and a second surface, wherein said first surface and said second surface both extend from a wide base rim to a first central apex, wherein a first aperture is disposed through said lower hemispherical section at said first central apex, and wherein said lower hemispherical section is selectively positionable between a normal orientation, where said first surface faces outwardly, and an inverted orientation, where said second surface faces outwardly; and an upper hemispherical section having a second central apex, wherein a second aperture is disposed through said upper hemispherical section at said second central apex, and an elongated shaft joining said lower hemispherical section to said upper hemispherical section, said elongated shaft having an impact disc at one end, a knob at an opposite end, and a stop disc disposed on said elongated shaft proximate said impact disc;

wherein said elongated shaft extends through said first aperture of said lower hemispherical section between said impact disc and said stop disc, therein mechanically interlocking said elongated shaft with said lower hemispherical section; and wherein said elongated shaft extends through said second aperture of said upper hemispherical section between said stop disc and said knob, therein enabling said elongated shaft to freely move through said second aperture between said stop disc and said knob as said lower hemispherical section moves between said normal orientation and said inverted orientation;

wherein said upper hemispherical section and said lower hemispherical section form a spherical shape when said lower hemispherical section is in said normal orientation.

2. The assembly according to claim 1, wherein said lower hemispherical section and said upper hemispherical section are made of dissimilar elastomeric materials, wherein said lower hemispherical section has a durometer greater than that of said upper hemispherical section.

3. The assembly according to claim 1, wherein said lower hemispherical section is symmetrically disposed around a mid-axis and said elongated shaft extends along said mid-axis.

4. The assembly according to claim 3, wherein said base rim exists in a plane that is perpendicular to said mid-axis.

5. The assembly according to claim 1, wherein said lower hemispherical section tapers in thickness between said first surface and said second surface, from a first thickness at said base rim to a second larger thickness at a transition plane between said base rim and said central apex.

6. The assembly according to claim 5, wherein said lower hemispherical section has a uniform thickness between said first surface and said second surface from said transition plane to said central apex.

7. A pop action toy ball assembly, comprising:

a first hemispherical section capable of being manually inverted between a normal orientation and an inverted orientation;

a second hemispherical section having an apex and an aperture that extends through said second hemispherical section at said apex;

an elongated shaft coupling said first hemispherical section to said second hemispherical section, said elongated shaft having a first end and a second end, wherein said first end of said elongated shaft is anchored to said first hemispherical section and wherein said elongated shaft extends through said aperture in said second hemispherical section before terminating at said second end, therein enabling said elongated shaft to freely move through said second aperture as said first hemispherical section moves between said normal orientation and said inverted orientation.

8. The assembly according to claim 7, wherein both said first hemispherical section and said second hemispherical section are made of elastomeric material.

9. The assembly according to claim 8, wherein said first hemispherical section has a durometer greater than that of said second hemispherical section.

10. A pop action toy assembly, comprising:

a first hemispherical body having a first surface and a second surface, wherein said first surface and said second surface both extend from a wide base rim to a first central apex, wherein said hemispherical body is selectively positionable between a stable normal orientation, where said first surface faces outwardly, and a stable inverted orientation, where said second surface faces outwardly;

a second hemispherical body having a second central apex, wherein an aperture is formed through said second hemispherical body at said second central apex; and an elongated shaft having a first end coupled to said first central apex of said first hemispherical body wherein said elongated shaft extends through said aperture in said second hemispherical body therein enabling said second hemispherical body to slide freely along said elongated shaft.

11. The assembly according to claim 10, wherein said first hemispherical body and said second hemispherical body are sized to form a uniform spherical ball when aligned.

12. The assembly according to claim 10, wherein first hemispherical body and said second hemispherical body are made of different materials, wherein said first hemispherical body has a durometer greater than that of said second hemispherical body.

* * * * *